US008317495B2

(12) United States Patent
Kang et al.

(10) Patent No.: US 8,317,495 B2
(45) Date of Patent: Nov. 27, 2012

(54) LINEAR COMPRESSOR

(75) Inventors: Yang-Jun Kang, Changwon-shi (KR); Young-Hoan Jeon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 237 days.

(21) Appl. No.: 12/739,441

(22) PCT Filed: Oct. 9, 2008

(86) PCT No.: PCT/KR2008/005951

§ 371 (c)(1),
(2), (4) Date: Jul. 29, 2010

(87) PCT Pub. No.: WO2009/054630

PCT Pub. Date: Apr. 30, 2009

(65) Prior Publication Data

US 2010/0290936 A1 Nov. 18, 2010

(30) Foreign Application Priority Data

Oct. 24, 2007 (KR) ..... 10-2007-0107331

(51) Int. Cl.
*F04B 53/00* (2006.01)

(52) U.S. Cl. ..... 417/417; 417/312

(58) Field of Classification Search ..... 417/312, 417/417

See application file for complete search history.

(56) References Cited

U.S. PATENT DOCUMENTS 6,413,057 B1 7/2002 Hong et al.
2006/0093495 A1 * 5/2006 Oh et al. ..... 417/417

FOREIGN PATENT DOCUMENTS

DE 102005005698 5/2006

OTHER PUBLICATIONS

International Search Report issued in PCT/KR2008/005951 dated Feb. 4, 2009.

* cited by examiner

*Primary Examiner* — Charles Freay
*Assistant Examiner* — Patrick Hamo
(74) *Attorney, Agent, or Firm* — KED & Associates LLP

(57) ABSTRACT

A linear compressor is provided that includes a stationary member including a cylinder that provides a space to compress a refrigerant; a movable member that linearly reciprocates with respect to the stationary member, and that includes a piston that compresses the refrigerant inside the cylinder and a supporter piston having a support portion that extends in a radial direction of the piston; front main springs positioned so as to be symmetrical with respect to centers of the piston and the supporter piston, one ends of which are supported by a front surface of the support portion of the supporter piston and the other ends of which are supported by the stationary member; a rear main spring, one end of which is supported by a back surface of the supporter piston; a suction muffler that provides a passage to introduce the refrigerant while reciprocating with the movable member, reduces noise, and includes an extended part that extends toward the supporter piston; and a spring guide fixed to the supporter piston to support one end of the rear main spring on the front surface. A recessed part having a size sufficient to accommodate the extended part of the suction muffler is formed on the back surface of the spring guide.

20 Claims, 5 Drawing Sheets

LINEAR COMPRESSOR

TECHNICAL FIELD

The present invention relates to a linear compressor, and more particularly, to a linear compressor, which avoids direct contact with a suction muffler so as to prevent plastic deformation caused by the load of the rear main spring received by the suction muffler by having three main springs having a resonance frequency matched to a driving frequency of the linear compressor.

BACKGROUND ART

In general, a compressor is a mechanical apparatus for compressing the air, refrigerant or other various operation gases and raising a pressure thereof, by receiving power from a power generation apparatus such as an electric motor or turbine. The compressor has been widely used for an electric home appliance such as a refrigerator and an air conditioner, or in the whole industry.

The compressors are roughly classified into a reciprocating compressor in which a compression space for sucking or discharging an operation gas is formed between a piston and a cylinder, and the piston is linearly reciprocated inside the cylinder, for compressing a refrigerant, a rotary compressor in which a compression space for sucking or discharging an operation gas is formed between an eccentrically-rotated roller and a cylinder, and the roller is eccentrically rotated along the inner wall of the cylinder, for compressing a refrigerant, and a scroll compressor in which a compression space for sucking or discharging an operation gas is formed between an orbiting scroll and a fixed scroll, and the orbiting scroll is rotated along the fixed scroll, for compressing a refrigerant.

Recently, a linear compressor which can improve compression efficiency and simplify the whole structure without a mechanical loss resulting from motion conversion by connecting a piston directly to a linearly-reciprocated driving motor has been popularly developed among the reciprocating compressors.

Normally, in the linear compressor, a piston is linearly reciprocated in a cylinder by a linear motor inside a hermetic shell, for sucking, compressing and discharging a refrigerant. The linear motor includes a permanent magnet disposed between an inner stator and an outer stator, and the permanent magnet is linearly reciprocated due to a mutual electromagnetic force. As the permanent magnet is driven in a state where it is coupled to the piston, the piston is reciprocated linearly inside the cylinder to suck, compress, and discharge the refrigerant.

FIG. 1 is a view illustrating a conventional linear compressor.

Referring to FIG. 1, in the conventional linear compressor 1, a piston 30 is linearly reciprocated inside a cylinder 20 by a linear motor 40 in a hermetic shell 10 so as to suck, compress and discharge refrigerant. The linear motor 40 includes an inner stator 42, an outer stator 44, and a permanent magnet 46. The permanent magnet 46 is linearly reciprocated between the inner stator 42 and the outer stator 44 due to a mutual electromagnetic force. As the permanent magnet 46 is driven in a state where it is coupled to the piston 30, the piston 30 is linearly reciprocated inside the cylinder 20 to suck, compress and discharge refrigerant.

The linear compressor 1 further includes a frame 52, a stator cover 54, and a back cover 56. The linear compressor may have a configuration in which the cylinder 20 is fixed by the frame 52, or a configuration in which the cylinder 20 and the frame 52 are integrally formed. At the front of the cylinder 20, a discharge valve 62 is elastically supported by an elastic member, and selectively opened and closed according to the pressure of the refrigerant inside the cylinder. 20. A discharge cap 64 and a discharge muffler 66 are installed at the front of the discharge valve 62, and the discharge cap 64 and the discharge muffler 66 are fixed to the frame 52. One end of the inner stator 42 or outer stator 44 as well is supported by the frame 52, and an 0-ring or the like of the inner stator 42 is supported by a separate member or a projection formed on the cylinder 20, and the other end of the outer stator 44 is supported by the stator cover 54. The back cover 56 is installed on the stator cover 54, and a suction muffler 70 is positioned between the back cover 56 and the stator cover 54.

Further, a supporter piston 32 is coupled to the rear of the piston 30. Main springs 80 whose natural frequency is adjusted are installed at the supporter piston 32 so that the piston 30 can be resonantly moved. The main springs 80 are divided into front springs 82 whose both ends are supported by the supporter piston 32 and the stator cover 54 and rear springs 84 whose both ends are supported by the supporter piston 32 and the back cover 56. Here, the main springs 80 include four front springs 82 and four rear springs 84. Accordingly, this large number of the main springs 80 leads to a large number of positional parameters to be controlled in order to maintain balance upon movement of the piston 30. Consequently, the manufacturing process becomes complicated and longer and the manufacturing cost is high.

In addition, the suction muffler 70 receives a direct load from the rear springs 84 at a portion fixed to the supporter piston 32 by a fastening member. In this structure, plastic deformation occurs at an extended part of the suction muffler, thereby causing variations in the mounting distance of springs and creating a problem in the control reliability of the linear compressor.

DISCLOSURE OF INVENTION

Technical Problem

The present invention has been made in an effort to solve the above-mentioned problems occurring in the conventional art, and an object of the present invention is to provide a spring guide of a linear compressor, which allows an extended part of a suction muffler to avoid from receiving the load of a rear main spring by having a recessed part larger than the thickness of the extended part of the suction muffler.

Technical Solution

The present invention provides a linear compressor, comprising: a stationary member including a cylinder for providing a space for compressing a refrigerant; a movable member linearly reciprocating with respect to the stationary member, and including a piston for compressing the refrigerant inside the cylinder and a supporter piston having a support portion extended in a radial direction of the piston; a plurality of front main springs positioned so as to be symmetrical with the center of the piston and the supporter piston, one ends of which being supported by the front surface of the support portion of the supporter piston and the other ends of which being supported by the stationary member; one rear main spring, one end of which being supported by the back surface of the supporter piston; a suction muffler for providing a passage for introducing a refrigerant while reciprocating with the movable member, reducing noise, and including an extended part extended toward the supporter piston; and a spring guide fixed to the supporter piston to support one end of the rear main spring on the front surface, a recessed part having a size enough to accommodate the extended part of the suction muffler being formed on the back surface of the spring guide.

In another aspect of the present invention, the extended part of the suction muffler is fixed to the supporter piston by a fastening member, and the spring guide is fixed to the supporter piston by another fastening member.

In another aspect of the present invention, the one fastening member for fastening the suction muffler and the another fastening member for fastening the spring guide are positioned in different locations.

In another aspect of the present invention, the suction muffler is connected at least one of the piston and the supporter piston, and passes through the spring guide.

Advantageous Effects

The thus-constructed linear compressor according to the present invention has the advantage of reducing parts production costs by decreasing the number of main springs.

Furthermore, the linear compressor according to the present invention has the advantage of avoiding direct contact with the suction muffler so as to prevent plastic deformation caused by the load of the rear main spring received through the spring guide.

MODE FOR THE INVENTION

Hereinafter, an embodiment of the present invention will be described in detail with reference to the accompanying drawings.

Figure 1:
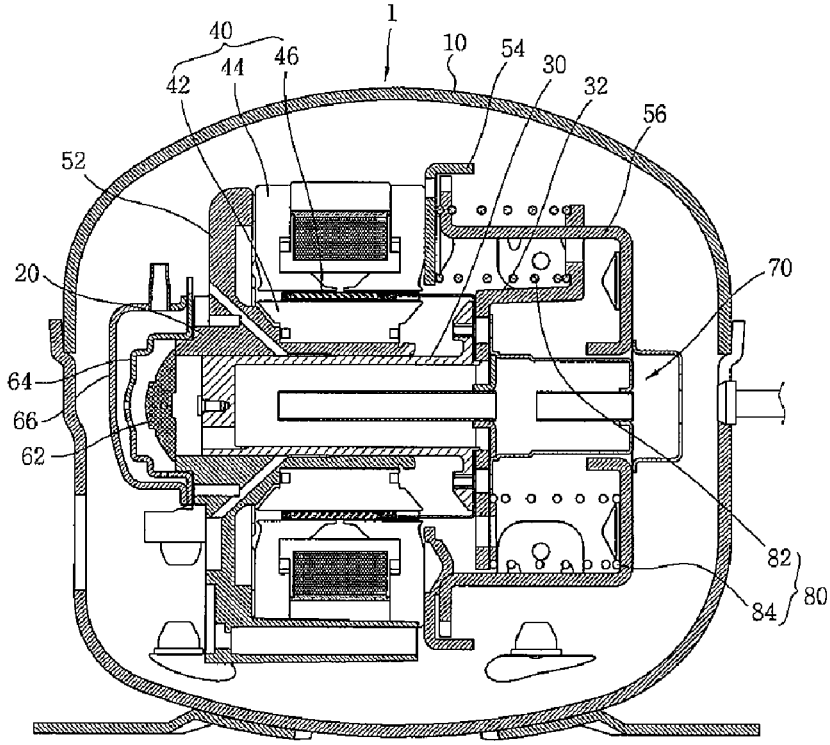
FIG. 1 is a side cross sectional view illustrating a conventional linear compressor.
Figure 2:
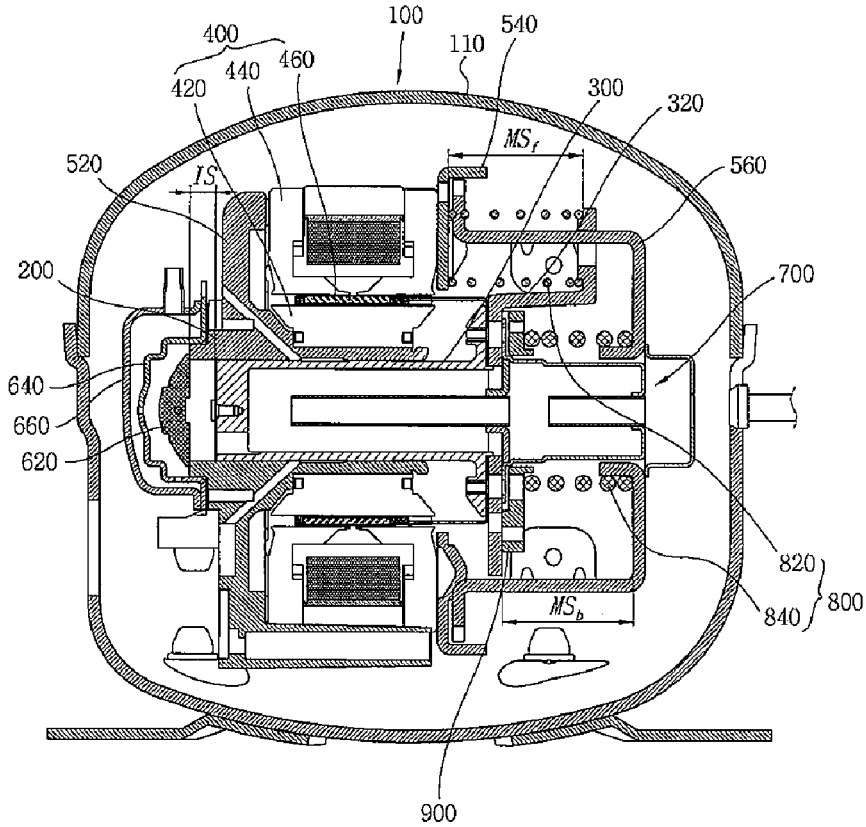
FIG. 2 is a side cross sectional view illustrating a linear compressor according to the present invention.
Figure 3:
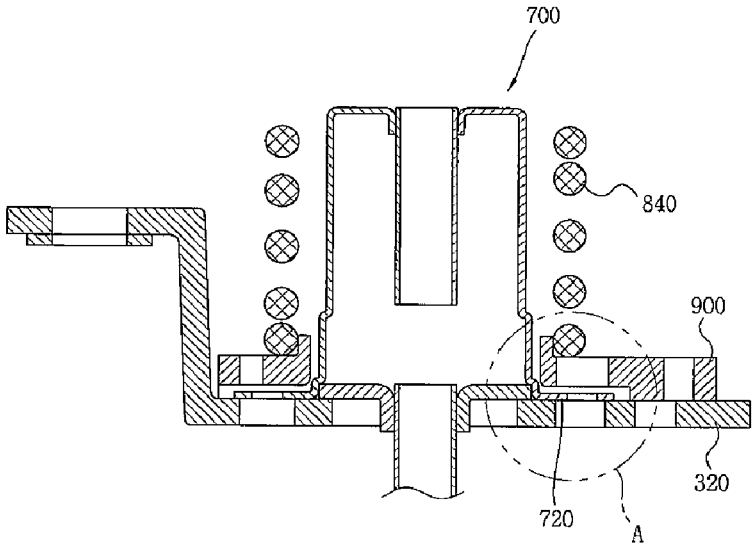
FIG. 3 is a side cross sectional view illustrating a rear main spring part of the linear compressor according to the present invention.
Figure 4:
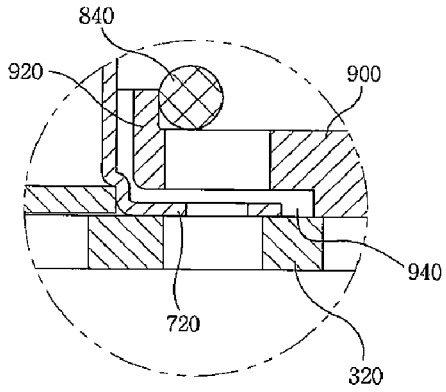
FIG. 4 is a side cross sectional view enlargedly illustrating a portion A of FIG. 3.

FIG. 2 is a side cross sectional view illustrating a linear compressor according to the present invention. FIG. 3 is a side cross sectional view illustrating a rear main spring part of the linear compressor according to the present invention. FIG. 4 is a side cross sectional view enlargedly illustrating a portion A of FIG. 3.

Referring to FIG. 2, a piston 300 is linearly reciprocated inside a cylinder 200 by a Linear motor 400 in a hermetic shell 110 so as to suck, compress and discharge refrigerant. The linear motor 400 includes an inner stator 420, an outer stator 440, and a permanent magnet 460. The permanent magnet 460 is linearly reciprocated between the inner stator 420 and the outer stator 440 due to a mutual electromagnetic force. As the permanent magnet 460 is driven in a state where it is coupled to the piston 300, the piston 300 is linearly reciprocated inside the cylinder 200 to suck, compress and discharge refrigerant.

The linear compressor 100 further includes a frame 520, a stator cover 540, and a back cover 560. The linear compressor may have a configuration in which the cylinder 200 is fixed by the frame 520, or a configuration in which the cylinder 200 and the frame 520 are integrally formed. At the front of the cylinder 200, a discharge valve 620 is elastically supported by an elastic member, and selectively opened and closed according to the pressure of the refrigerant inside the cylinder 200. A discharge cap 640 and a discharge muffler 660 are installed at the front of the discharge valve 620, and the discharge cap 640 and the discharge muffler 660 are fixed to the frame 520. One end of the inner stator 420 or outer stator 440 as well is supported by the frame 520, and an O-ring or the like of the inner stator 420 is supported by a separate Member or a projection formed on the cylinder 200, and the other end of the outer stator 440 is supported by the stator cover 540. The back cover 560 is installed on the stator cover 540, and a suction muffler 700 is positioned between the back cover 560 and the stator cover 540.

Further, a supporter piston 320 is coupled to the rear of the piston 300. Main springs 800 whose natural frequency is adjusted are installed at the supporter piston 320 so that the piston 300 can be resonantly moved. The main springs 800 are divided into front main springs 820 whose both ends are supported by the supporter piston 320 and the stator cover 540 and a rear main spring 840 whose both ends are supported by the supporter piston 320 and the back cover 560. Here, the center of the rear main spring 840 coincides with the center of the piston 300.

The suction muffler 700 is connected to at least one of the piston 300 and the supporter piston 320 so as to be positioned inside the rear main spring 840 and the piston 300, and introduces a refrigerant into the piston 300. Here, the suction muffler 700 passes through a spring guide 900. In addition, the suction muffler 700 may be made from an injection moldable material.

The mounting distances MSf and Msb of the front main springs 820 and rear main spring 840 may act as a factor capable of varying the distance (initial value, IS) between the piston and the cylinder. The present invention prevents any variation of the initial value IS so that there is no problem in control reliability. To this end, the present invention provides a structure in which the spring guide 900 and the suction muffler 700 are not in direct contact with each other, and is able to avoid plastic deformation of an extended part of the suction muffler made of plastic.

FIG. 3 allows for a structural understanding focused on the rear main spring part of the linear compressor according to the present invention. First, one end of the rear main spring 840 is supported by the spring guide 900 and stably mounted.

More specifically, an extended part 720 of the suction muffler formed in a flange shape is fixed by a fastening member in a radial direction of the supporter piston 320. The spring guide 900 forms a structure in which the depth of a recessed part is greater than the thickness of the extended part 720 such that the extended part 720 of the suction muffler 700 is accommodated on the back surface of the surface on which the rear main spring 840 is supported. Here, care should be taken not to generate a contact surface between the extended part 720 of the suction muffler and the spring guide 900. In this manner, when the spring guide 900 is fixed to the supporter piston 320 by a fastening member, the rear main spring 840 may be supported, and at the same time the load of the rear main spring 840 may not be transferred to the extended part 720 of the suction muffler.

In FIG. 4, the structure of the spring guide 900 and the extended part 720 of the suction muffler can be seen in detail. The extended part 720 of the suction muffler is fixed to the supporter piston 320 by a fastening member. The spring guide 900 supports the rear main spring 840. Here, an evacuation structure of the extended part 720 of the suction muffler 700 and the fastening member of the supporter piston 320 may be formed at the spring guide 900, and the recessed part 940 of the spring guide 900 has a greater depth than the thickness of the extended part 720 of the suction muffler 700. Therefore, the recessed part 940 of the spring guide 900 can form a structure having no contact with the extended part 720 of the suction muffler 700 on the back surface of the surface on which the rear main spring 840 is supported.

Here, since the spring guide 900 is fixed to the supporter piston 320 by a fastening member, the load of the rear main spring 840 can be transferred to the supporter piston 320 via the spring guide 900. The load of the rear main spring 840 may not be transferred to the suction muffler 700 in this manner. Therefore, it is possible to avoid plastic deformation of the extended part 720 of the suction muffler due to the load of the rear main spring 840.

Figure 5:
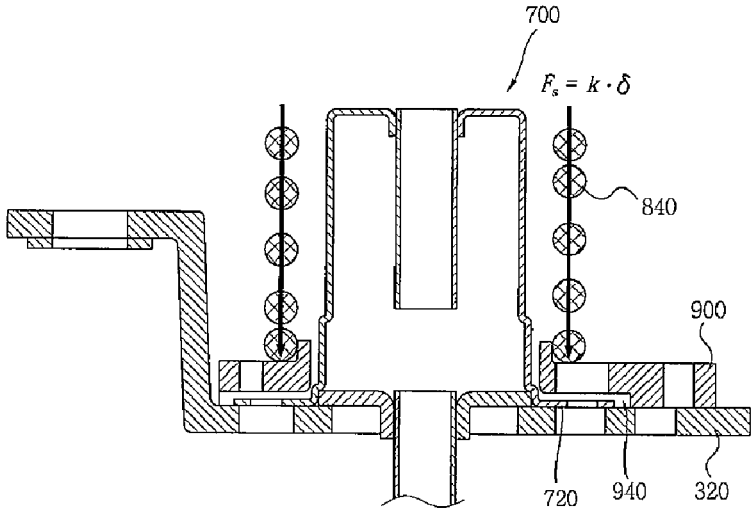
FIG. 5 is a view illustrating a load relationship of the extended part of the suction muffler according to the present invention.
Figure 6:
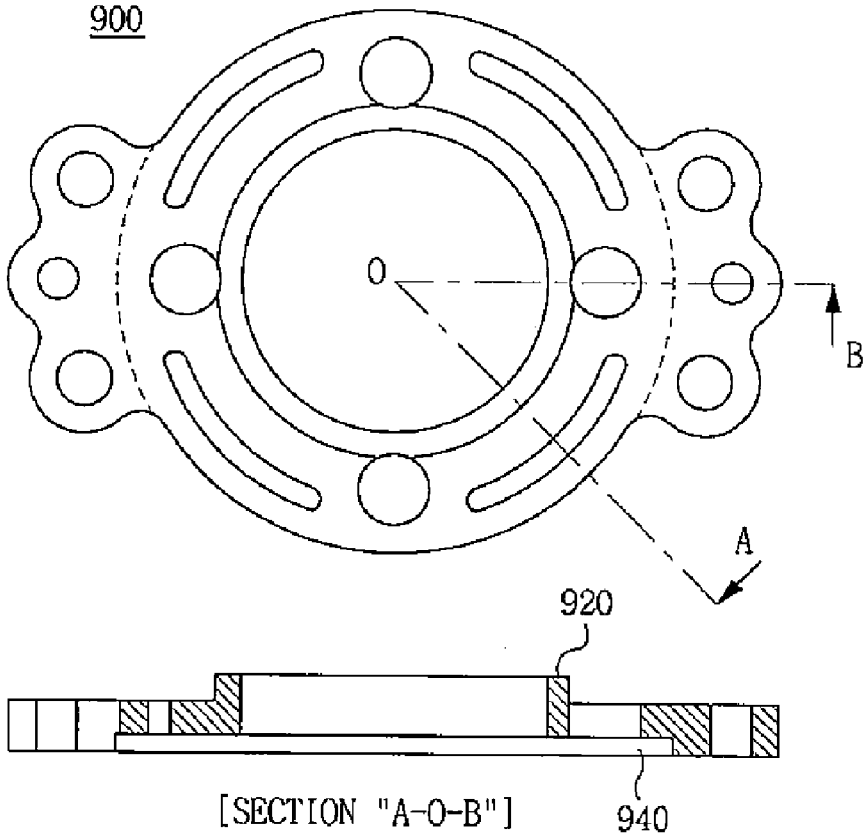
FIG. 6 is a plan view of the spring guide according to the present invention and a cross sectional view taken along line A-O-B.
Figure 7:
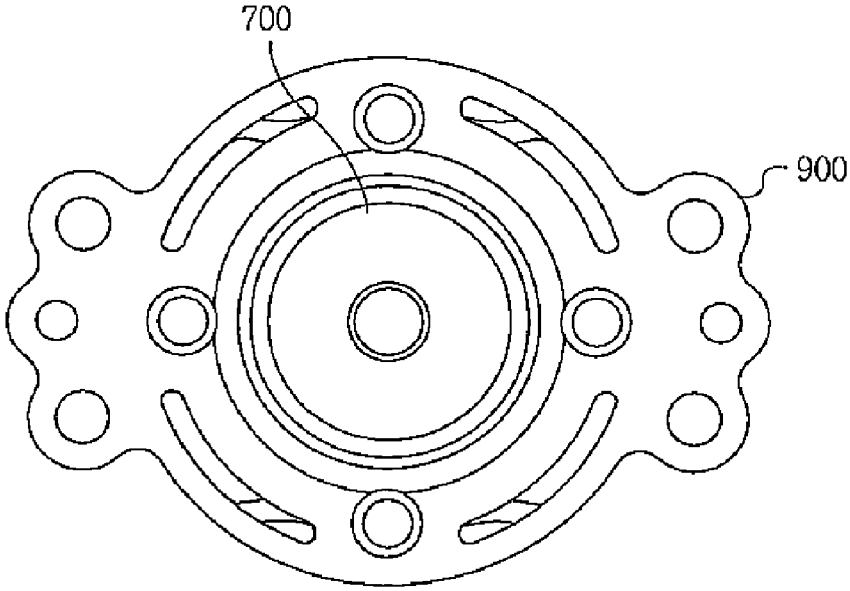
FIG. 7 is a view illustrating the overlapping of the spring guide and the suction muffler according to the present invention.
Figure 8:
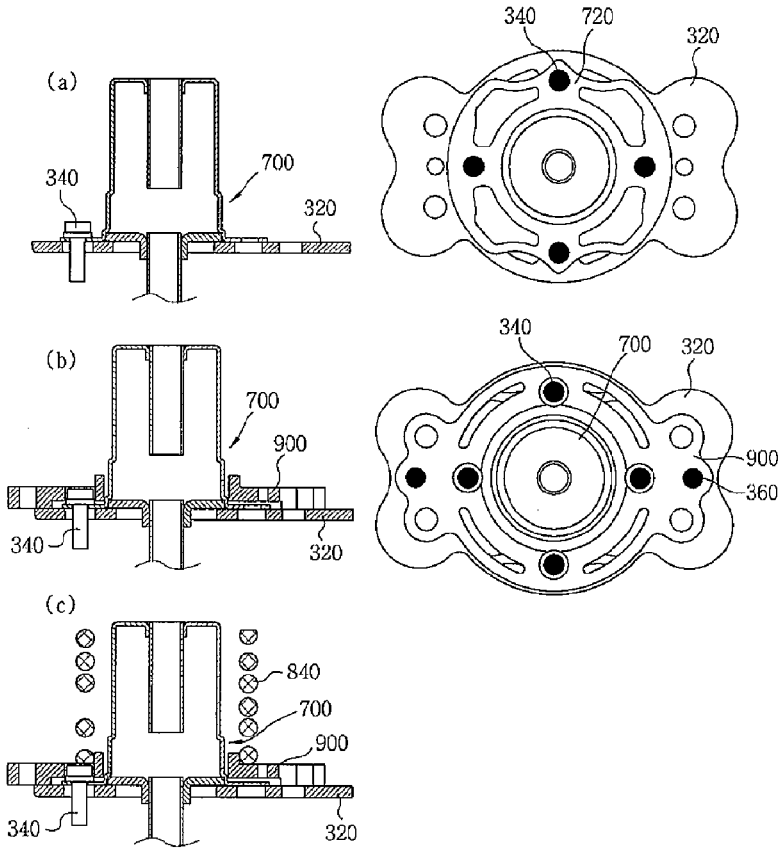
FIG. 8 is a view illustrating a fixed structure of the suction muffler and the spring guide according to the present invention.

FIG. 5 is a view illustrating a load relationship of the extended part of the suction muffler according to the present invention. FIG. 6 is a plan view of the spring guide according to the present invention and a cross sectional view taken along line A-O-B. FIG. 7 is a view illustrating the overlapping of the spring guide and the suction muffler according to the present invention. FIG. 8 is a view illustrating a fixed structure of the suction muffler and the spring guide according to the present invention.

In FIG. 5, as the rear main spring 840 is compressed and expanded, when spring constant K and amount of compression δ are taken into consideration, a load Fs of the rear main spring calculated according to the following equation is applied to the spring guide 900.

[Equation]

$$F_s = K \cdot \delta$$

wherein it is shown that the load (Fs; arrow) of the rear main spring is supported by the spring guide 900. A recessed part 940 having a greater depth than the thickness of the extended part 720 of the suction muffler 700 made of plastic is formed on the back surface of the surface on which the load of the rear main spring 840 is supported by the spring guide 900. This forms a structure in which the spring guide 900 and the extended part 720 of the suction muffler 700 are not in contact with each other. Thus, the load of the rear main spring 840 is transferred not to the extended part 720 of the suction muffler 700 but to the supporter piston 320.

Conventionally, the load of the rear main spring 840 is directly applied to the extended part 720 of the suction muffler 700 made of plastic, thus giving rise to plastic deformation at the extended part 720 of the suction muffler 700. As a result, the mounting distances Msf and MSb of the front main spring 820 and rear main spring 840 of FIG. 2 are varied, and the distance (initial value, IS) between the piston and the cylinder is varied. When such a variation of the initial value IS occurs, this causes a problem in control reliability. To avoid this problem, the present invention is to provide a structure in which the spring guide 900 and the suction muffler 700 are not in direct contact with each other and to eliminate plastic deformation of the extended part 720 of the suction muffler made of plastic.

FIG. 6 illustrates the spring guide 900 according to the present invention. To one end of the rear main spring 840, the stepped part 920 of the spring guide 900 is fitted. The recessed part 940 larger than the thickness of the extended part 720 of the suction muffler 700 is provided on the outer side of the stepped part 920 of the spring guide to accommodate the suction muffler 700 on the back surface of the surface on which the rear main spring 840 is supported. Here, the suction muffler 700 penetrates the center of the spring guide 900. A gap may be formed so as not to allow the extended part 720 of the suction muffler 700 to make contact with the dotted-line portion of the spring guide 900 of FIG. 6.

FIG. 7 is a view illustrating the overlapping of the spring guide 900 and the suction muffler 700 according to the present invention, in which the outer circumferential portions do not overlap with each other. Of course, as the suction muffler 700 penetrates the center of the spring guide 900, most of the extended part 720 of the suction muffler is 700 shielded and not visible.

FIG. 8 sequentially illustrates a fixed structure of the suction muffler 700 and the spring guide 900 according to the present invention.

First, the right side of step (a) at the upper part depicts a view in which the suction muffler 700 is fastened to the supporter piston 320. A fastening bolt 340 is used for a guide hole so that the extended part 720 of the suction muffler 700 is fastened to the supporter piston 320. Here, four fastening bolts 340 are used. In addition, the left side depicts a cross sectional view corresponding to this depiction.

The right side of step (b) at the middle part depicts a view of the spring guide 900 assembled after the suction muffler 700 is fastened to the supporter piston 320. The spring guide 900 uses two fastening bolts 360 for a guide hole corresponding to the outer diameter of the suction muffler 700 so as to be fastened to the supporter piston 320. Here, before fixing the spring guide 900 to the supporter piston 320 by the fastening bolts 360, a separate hole may be formed on the supporter piston 320 and used for fastening. In addition, the left side depicts a cross sectional view corresponding to this depiction. Here, the spring guide 900 forms an evacuation structure for the fastening bolts 340 fixing the extended part 720 of the suction muffler 700 and the supporter piston 320. Finally, step (c) is a view in which the rear main spring 840 is additionally assembled. The structure for fixing the suction muffler 700 and the spring guide 900 in this order has a two-stage fastening structure in which the suction muffler 700 is mounted and fastened to an upper end portion of the supporter piston 320 and then the spring guide 900 is fastened to the supporter piston 320. When the suction muffler 700 and the spring guide 900 have such a two-stage fastening structure and receives a load of the rear main spring 840, the load of the rear main spring 840 is not directly transferred to the suction muffler 700.

Figure 9:
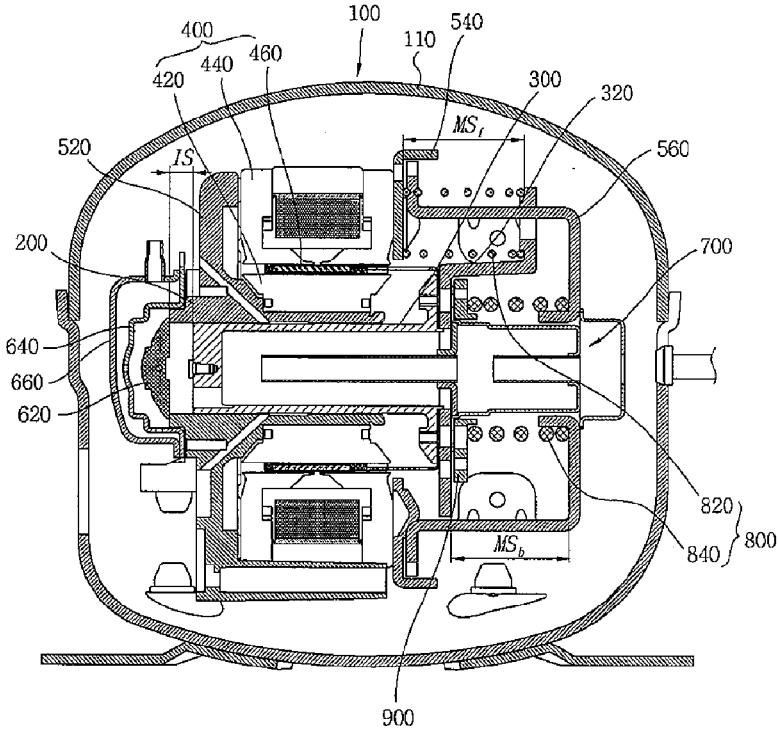
FIG. 9 is a side view of a linear compressor illustrating a comparative example.
Figure 10:
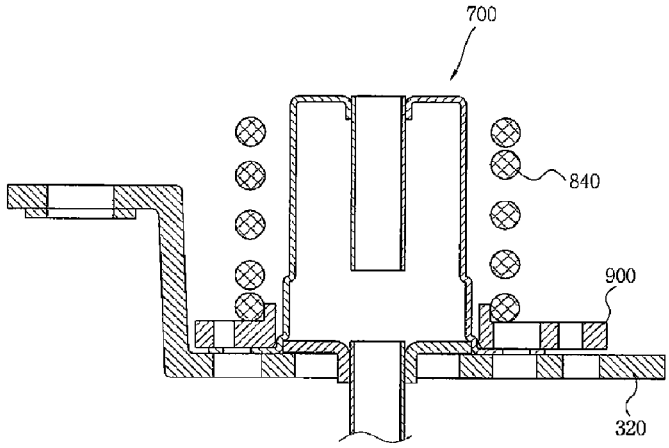
FIG. 10 is a side cross sectional view illustrating a rear main spring part of the comparative example.
Figure 11:
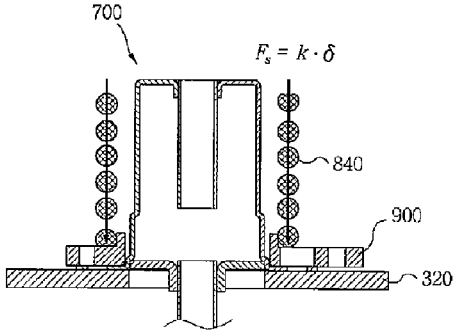
FIG. 11 is a side cross sectional view illustrating a load relationship of the extended part of the suction muffler in the comparative example.
Figure 12:
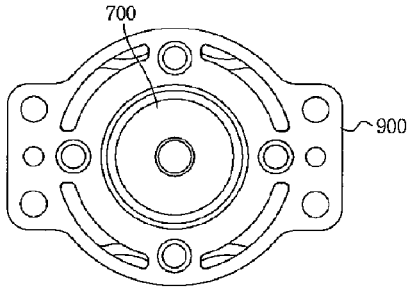
FIG. 12 is a view illustrating the overlapping of the suction muffler and the spring guide in the comparative example.
Figure 13:
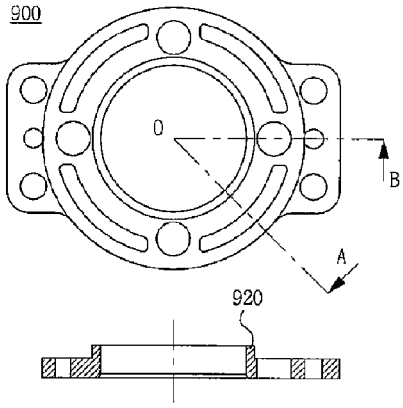
FIG. 13 is a view of the spring guide in the comparative example.

FIG. 9 is a side view of a linear compressor illustrating a comparative example. FIG. 10 is a side cross sectional view illustrating a rear main spring part of the comparative example. FIG. 11 is a side cross sectional view illustrating a load relationship of the extended part of the suction muffler in the comparative example. FIG. 12 is a view illustrating the overlapping of the suction muffler and the spring guide in the comparative example. FIG. 13 is a view of the spring guide in the comparative example.

Unlike the present invention, FIG. 9 shows a comparative example in which the spring guide 900 is in direct contact with the suction muffler 700.

FIG. 10 shows in detail that the spring guide 900 supporting the rear main spring 840 is in direct contact with the extended part 720 of the muffler.

Here, unlike FIG. 3, the spring guide 900 has no recessed part for accommodating the suction muffler 700 formed on the back surface of the surface on which the rear main spring 840 is supported. In addition, the extended part 720 of the suction muffler 700 and the spring guide 900 are fastened together to the supporter piston 320.

In FIG. 11, as the spring guide 900 and the suction muffler 700 are in direct contact with each other, they directly receive the load of the rear main spring 840. Here, the extended part 720 of the suction muffler 700 made of plastic undergoes plastic deformation.

Here, as the rear main spring 840 is compressed and expanded, when K is a spring constant N/m and δ is an amount of compression (m), the load Fs of the rear main spring applied to the extended part of the suction muffler is expressed by $Fs=K\cdot\delta$.

If the load of the rear main spring 840 is directly applied to the extended part 720 of the suction muffler 700 made of plastic, plastic deformation occurs. As a result, the mounting distances MSf and MSb of the front main springs 820 and rear main spring 840 of FIG. 9 are varied and the distance (initial value, IS) between the piston and the cylinder is varied. When such a variation of the initial value IS occurs, this causes a problem in control reliability.

FIG. 12 depicts the overlapping of the suction muffler and the spring guide in the comparative example. The suction muffler 700 penetrates the center of the spring guide 900. At this moment, most of the extended part of the suction muffler is shielded and not visible.

FIG. 13 shows a plan view of the spring guide and a side view taken along line A-O-B in the comparative example.

To one end of the rear main spring 840, the stepped part 920 of the spring guide 900 as shown in FIG. 13 may be fitted. Compared with FIG. 6, no recessed part larger than the thickness of the extended part 720 of the suction muffler 700 is provided on the outer side of the stepped part 920 of the spring guide 900 to accommodate the suction muffler 700 on the back surface of the surface on which the rear main spring 840 is supported.

As such, the spring guide 900 of the linear compressor according to the present invention has a structure in which the load of the rear main spring 840 is not directly transferred to the extended part 720 of the suction muffler made of plastic. That is to say, a recessed part having a depth larger than the thickness of the extended part 720 of the suction muffler is provided so as to prevent the suction muffler 700 and the spring guide 900 from overlapping with each other. This prevents plastic deformation at the extended part 720 of the suction muffler, thereby ensuring the control reliability of the linear compressor.

In addition, the linear compressor according to the present invention can reduce parts production costs by decreasing the number of main springs.

The present invention described above is not limited to the aforementioned embodiment and the accompanying drawings. It will be apparent that those skilled in the art can make various substitutions, modifications and changes thereto without departing from the technical spirit of the present invention.

The invention claimed is:

1. A linear compressor, comprising:

a stationary member including a cylinder that provides a space to compress a refrigerant;

a movable member that linearly reciprocates with respect to the stationary member, and that includes a piston that compresses the refrigerant inside the cylinder and a supporter piston having a support portion that extends in a radial direction of the piston;

a plurality of front main springs positioned so as to be symmetrical with respect to centers of the piston and the supporter piston, one end of each of which is supported by a first surface of the support portion of the supporter piston and the other end of each of which is supported by the stationary member;

a rear main spring, one end of which is supported by a second surface of the supporter piston;

a suction muffler that provides a passage to introduce a refrigerant while reciprocating with the movable member, reduces noise, and includes an extended part that extends toward the supporter piston; and a spring guide fixed to the supporter piston that supports the one end of the rear main spring on a first surface of the spring guide, wherein a recessed part having a size sufficient to accommodate the extended part of the suction muffler is formed on a second surface of the spring guide.

2. The linear compressor of claim 1, wherein the extended part of the suction muffler is fixed to the supporter piston by a plurality of fastening members, and wherein the spring guide is fixed to the supporter piston by another plurality of fastening members.

3. The linear compressor of claim 2, wherein the plurality of fastening members that fastens the suction muffler and the another plurality of fastening members that fastens the spring guide are positioned in different locations.

4. The linear compressor of claim 2, wherein the spring guide has a plurality of fastening member accommodating holes that accommodates the plurality of fastening members that fastens the supporter piston and the suction muffler.

5. The linear compressor of claim 1, wherein the spring guide has a center aligned with centers of the piston and the supporter piston, and wherein the spring guide is fixed to the supporter piston.

6. The linear compressor of claim 1, wherein the spring guide has a stepped part that restricts a movement of the one end of the rear main spring in a radial direction of the spring guide.

7. The linear compressor of claim 1, wherein the supporter piston and the spring guide have at least one guide hole at corresponding positions to guide a coupling position.

8. The linear compressor of claim 1, wherein at least a portion of the spring guide that contacts with the rear main spring has a hardness greater than a hardness of the rear main spring.

9. The linear compressor of claim 1, wherein the suction muffler is connected with at least one of the piston or the supporter piston, and wherein the suction muffler passes through the spring guide.

10. The linear compressor of claim 1, wherein the suction muffler is made from an injection moldable material.

11. The linear compressor of claim 1, further comprising a back cover that supports the other end of the rear main spring.

12. The linear compressor of claim 1, wherein a depth of the recessed part is greater than a thickness of the extended portion of the suction muffler.

13. A linear compressor, comprising:

a hermetic container configured to be filled with a refrigerant;

a linear motor that includes an inner stator, an outer stator, and a permanent magnet;

a piston that is linearly reciprocated by the linear motor;

a cylinder that provides a space to compress the refrigerant upon linear reciprocation of the piston;

a supporter piston that includes a connecting portion connected to one end of the piston and contacting with the piston, a support portion that extends from the connecting portion, and an additional mass member fixing portion that extends from the connecting portion;

a plurality of front main springs mounted at positions symmetrical with respect to a center of the piston, one end of each of which is supported by a surface of the supporter piston;

a rear main spring, one end of which is supported by another surface of the supporter piston;

a suction muffler that provides a passage to introduce the refrigerant while reciprocating with the piston, reduces noise, and includes an extended part that extends toward the supporter piston; and a spring guide fixed to the supporter piston that supports the one end of the rear main spring on a first surface of the spring guide.

14. The linear compressor of claim 13, wherein a recessed part having a size sufficient to accommodate the extended part of the suction muffler is formed on a second surface of the spring guide.

15. The linear compressor of claim 13, wherein the extended part of the suction muffler is fixed to the supporter piston by a plurality of fastening members, and wherein the spring guide is fixed to the supporter piston by another plurality of fastening members.

16. The linear compressor of claim 15, wherein the plurality of fastening members that fastens the suction muffler and the another plurality of fastening members that fastens the spring guide are positioned in different locations.

17. The linear compressor of claim 13, wherein the suction muffler is connected with at least one of the piston or the supporter piston, and wherein the suction muffler passes through the spring guide.

18. The linear compressor of claim 13, further comprising a back cover that supports the other end of the rear main spring.

19. The linear compressor of claim 13, further comprising a stator cover that covers one end of the outer stator and the other end of each of the plurality of front main springs.

20. The linear compressor of claim 14, wherein a depth of the recessed part is greater than a thickness of the extended portion of the suction muffler.

* * * * *